United States Patent [19]

Ludvigson

[11] 4,102,408

[45] Jul. 25, 1978

[54] PILE DRIVING DEVICE

[76] Inventor: Birger Ludvigson, Södra Vägen 38, Göteborg, Sweden 41254

[21] Appl. No.: 770,811

[22] Filed: Feb. 22, 1977

[30] Foreign Application Priority Data

Feb. 26, 1976 [SE] Sweden ..... 76 02300

[51] Int. Cl.[2] ..... E02D 5/34

[52] U.S. Cl. ..... 173/2; 173/125; 173/131; 61/53.5

[58] Field of Search ..... 73/82, 84; 173/2, 20, 173/125, 126, 131; 61/53.5; 267/124, 125, 137, 113

[56] References Cited

U.S. PATENT DOCUMENTS

| | | | |
|---|---|---|---|
| 3,417,828 | 12/1968 | Duyster et al. | 61/53.5 X |
| 3,446,293 | 5/1969 | Guild et al. | 173/131 |
| 3,498,391 | 3/1970 | Guild et al. | 173/131 |
| 3,797,585 | 3/1974 | Ludvigson | 173/131 |
| 4,029,158 | 6/1977 | Gerrish | 173/131 |

FOREIGN PATENT DOCUMENTS

| | | | |
|---|---|---|---|
| 226,917 | 6/1969 | U.S.S.R. | 73/84 |
| 281,264 | 10/1971 | U.S.S.R. | 173/131 |
| 390,232 | 10/1973 | U.S.S.R. | 73/82 |

*Primary Examiner*—Lawrence J. Staab
*Attorney, Agent, or Firm*—Holman & Stern

[57] ABSTRACT

A gas cushion impact cap, used in connection with pile driving, is connected to an external pressure chamber holding an additional volume of gas, whereby there will be no appreciable change in the gas pressure during the impact. The gas pressure is primarily determined by varying the volume of a liquid contained in the pressure chamber, in response to the resistance met by the pile while penetrating the ground. The impact cap may be pre-loaded during an upwards movement, the pre-load being released upon the impact, to throw the hammer upwards again.

13 Claims, 5 Drawing Figures

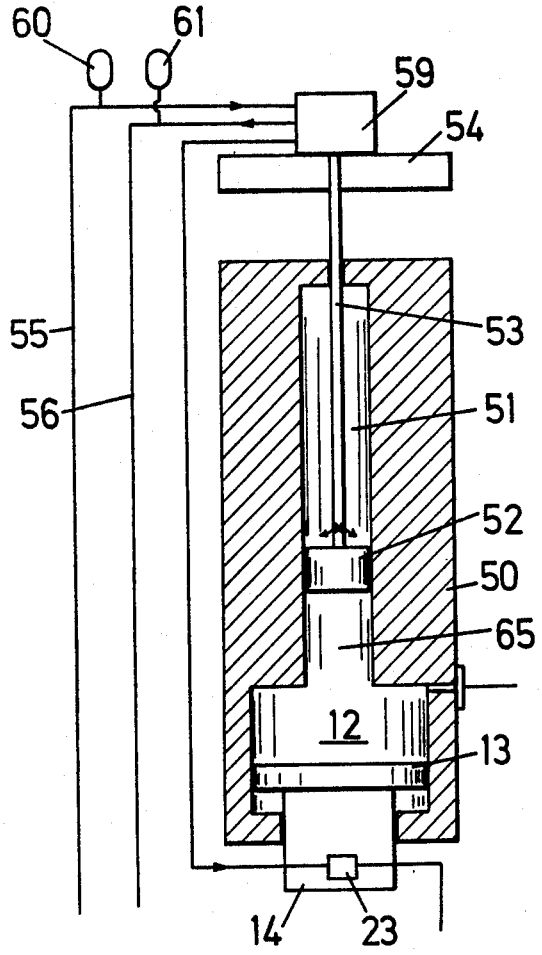
FIG. 4
FIG. 5
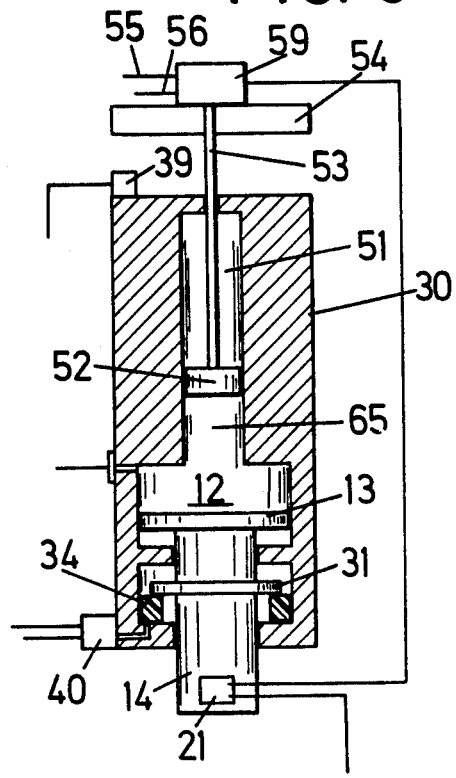

PILE DRIVING DEVICE

BACKGROUND OF THE INVENTION

The present invention refers to devices adapted to transfer impacts to elongate members, in the first hand suited for the driving of piles, the device using an impact cap including a piston operating in a cylinder, a portion of said piston extending outside the cylinder for acting upon the member, for instance the head of a pile. The cylinder encloses a volume of pressurized gas.

This pressure which in use may vary between 20 bar and 250 bar, must for each stroke of the hammer be adjusted in response to the resistance offered by the ground, when a pile is driven thereinto.

CROSS REFERENCE TO RELATED ART

In an earlier specification, U.S. Pat. No. 3,797,585, applicant proposes to arrange separate chambers within the impact cap, and to provide means for transferring oil and gas between these chambers. These proposals will, however, not provide ideal conditions when driving piles, which pre-supposes that the pressure within the gas chamber is proportional to the resistance encountered by the pile, while penetrating the ground. This resistance may, during the driving of one and the same pile call for variations in the pressure of the gas amounting to 5 or 10 times the lowest pressure used.

In arrangements, where the amount of gas is small, the volume will vary with the gas pressure, which means that there is a small volume when the pressure is high. The compression during the impact will further reduce the volume of gas, and bring about an undesirable variation in the force of the impact wave.

In an other embodiment pressurized gas is supplied to the chamber below the dropping hammer. When the resistance offered by the ground is high, i.e. usually towards the end of the driving operation, a pressure of 200 — 250 bar may be required in the impact cap. This pressure is not directly obtainable, but is the result of an adiabatic compression below the hammer, when this is decelerated. Here the desired maintenance of a constant impact-wave force is still worse, while simultaneously the arrangement wastes a considerable amount of driving fluid, i.e. compressed air.

With normally accepted pressure in the compressed air supplied the arrangement mainly serves to return the hammer to its starting position, for performing a new dropping action. By altering the pressure in the gas supplied, it is possible to alter the drop height of the hammer, and thus also the maximum value of the adiabatic pressure curve. The governing is purely pneumatic, whereas the invention proposes a hydraulic governing.

The function of last mentioned arrangement is basically the same as that of a diesel-hammer, where the additional energy is obtained by the injection of atomized fuel oil into the pressure chamber, the fuel being ignited by the heat of compression caused by the dropping hammer.

SUMMARY OF THE INVENTION

According to the invention it is now proposed that the means for governing the pressure of the gas within the cylinder shall include a pressure chamber, separate from the impact cap and containing gas and a liquid, as well as means for varying the volume of liquid within the pressure chamber.

The volume of the gas enclosed in the impact cap may be bigger than beforehand, as no liquid is contained in the cap, and the volume is not dependent upon the pressure of the gas. The volume, furter, is not affected by possible leakage of gas.

The means determining the volume of liquid preferably includes a pump, a receptacle for the fluid, and a valve adapted to govern flow in to, and out of, said pressure chamber, respectively in depence upon signals received from a transmitter located at the piston and/or at the member.

The impact cap is preferably integral with the hammer, but may also be a separate unit, to be located between the hammer and the head of the member.

According to a development of the invention, means located separately with respect to the impact cap, but connected thereto, are adapted to impart a pre-load upon impact cap, said pre-load being released by the impact upon the member.

The pre-load is obtainable by means of pressure fluid, being supplied by two pumps operating in parallel, one of said pumps having a fixed displacement, preferably covering one half of the maximum demand, while the other pump is designed for a variable displacement.

The latter pump is preferably governed by a signal transmitter mounted upon the hammer, or upon the piston.

According to a further embodiment of the invention the integral hammer and impact cap includes a further cylinder, in which a second piston, being stationary with respect to the surroundings, is mounted at a hollow piston rod, reaching outside the hammer and being connected to means for the supplying and withdrawal, respectively, of a pressure fluid, whereby the hammer may be raised and dropped with respect to the second piston. A signal transmitter attached to the piston of the impact cap, or to the hammer, possibly the signal transmitter governing the gas pressure in the cylinder of the impact cap, will determine the flow of hydraulic fluid. It is also possible to let the pressure in the cylinder of the impact cap influence the lifting of the hammer, and to that end means are provided to communicate the second cylinder with the cylinder in the impact cap.

BRIEF DESCRIPTION OF THE DRAWINGS

FIGS. 4 and 5 show embodiments including integral hammer and impact cap, corresponding to those in FIGS. 3 and 2, respectively, arranged for hydraulic raising of the hammer, but where the drop-height of the hammer is influenced by the pressure in the impact cap.

DESCRIPTION OF SOME PREFERRED EMBODIMENTS

Figure 1:
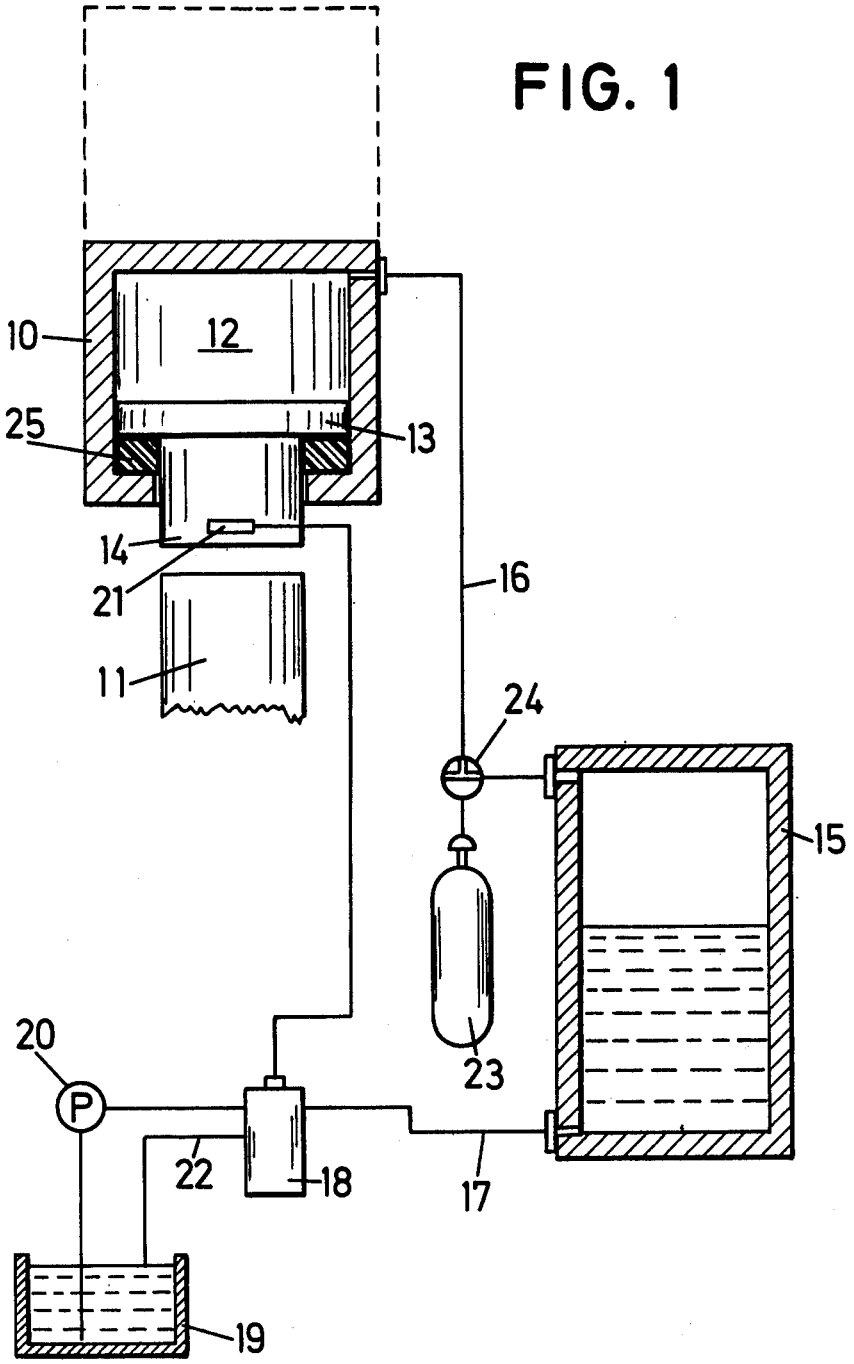
FIG. 1 schematically shows an impact cap for use when driving piles, and provided with means for governing the pressure in its cylinder according to the invention.

The arrangement schematically shown in FIG. 1 is adapted for driving piles. The pile-driver derric is not shown, only the hammer and the impact cap 10 integral therewith, as well as the head of the pile 11.

The impact cap, includes, in a manner known per se, a cylinder 12, in which a stepped piston 13 operates. The end portion 14 of the piston extends out of the cylinder, and is adapted to work against the head of the pile.

The chamber in cylinder 12, above piston 13, is filled with pressurized gas, and the piston is, in its most forward position, supported by an annular member 25 of resilient material.

When the hammer with its impact cap strikes against the pile the gas within cylinder 12 will be momentarily compressed, but will expand immediately. If the volume of gas is big, compared to the reduction in volume caused by the impact, the pressure wave generated in the pile will be ideal with respect to penetration. In comparison to embodiments where the hammer acts directly upon the head of the pile, or against a rather solid intermediary, or against a cap enclosing a small gas volume, the driving of a pile according to the invention will be more efficient, and the pile is subjected to less risk of damages.

The pressure within the cylinder will during the driving operation be varied by means including a pressure chamber 15, which by a conduit 16 is connected to cylinder 12, and further, by way of a conduit 17, communicates with a switch-over valve 18.

The pressure chamber contains gas as well as oil, and by varying the volume of oil within the pressure chamber it is possible, rapidly to alter the pressure of the gas, in pressure chamber 15, as well as in cylinder 12.

A receptacle 19, separate from pressure chamber 15 contains a sufficient quantity of oil, and a pump 20 is provided to transfer oil into the pressure chamber.

Switch-over valve 18, which may be a solenoid valve of known design, is governed by a signal transmitter, in the present embodiment mounted upon the protruding portion 14 of the piston. The signal transmitter may, however, alternatively be mounted at the head of the pile. The signal emitter may for instance be adapted to sense the appearance of reflected waves at the pile heads, such reflected waves being a function of the resistance encountered by the point of the pile while penetrating the ground, and to govern the pressure within cylinder 12 in response thereto.

This governing includes positioning valve 18 so it either permits the pump to supply oil to the pressure chamber, or withdraws oil therefrom for return flow by way of a conduit 22 to receptacle 19.

A gas accumulator 23 is connectable to pressure chamber 15 by means of a three-way valve 24. By means of a loaded accumulator it is possible, when starting up the system, rapidly to reach the desired high pressure level. When the operation is to be terminated, and it is undesirable to permit the high pressure to be maintained in the pressure chamber, the cylinder and the piping, it is possible, by re-positioning valve 24, to load accumulator 23 with the pressure remaining in the system, and then to shut the accumulator off from the same.

Figure 2:
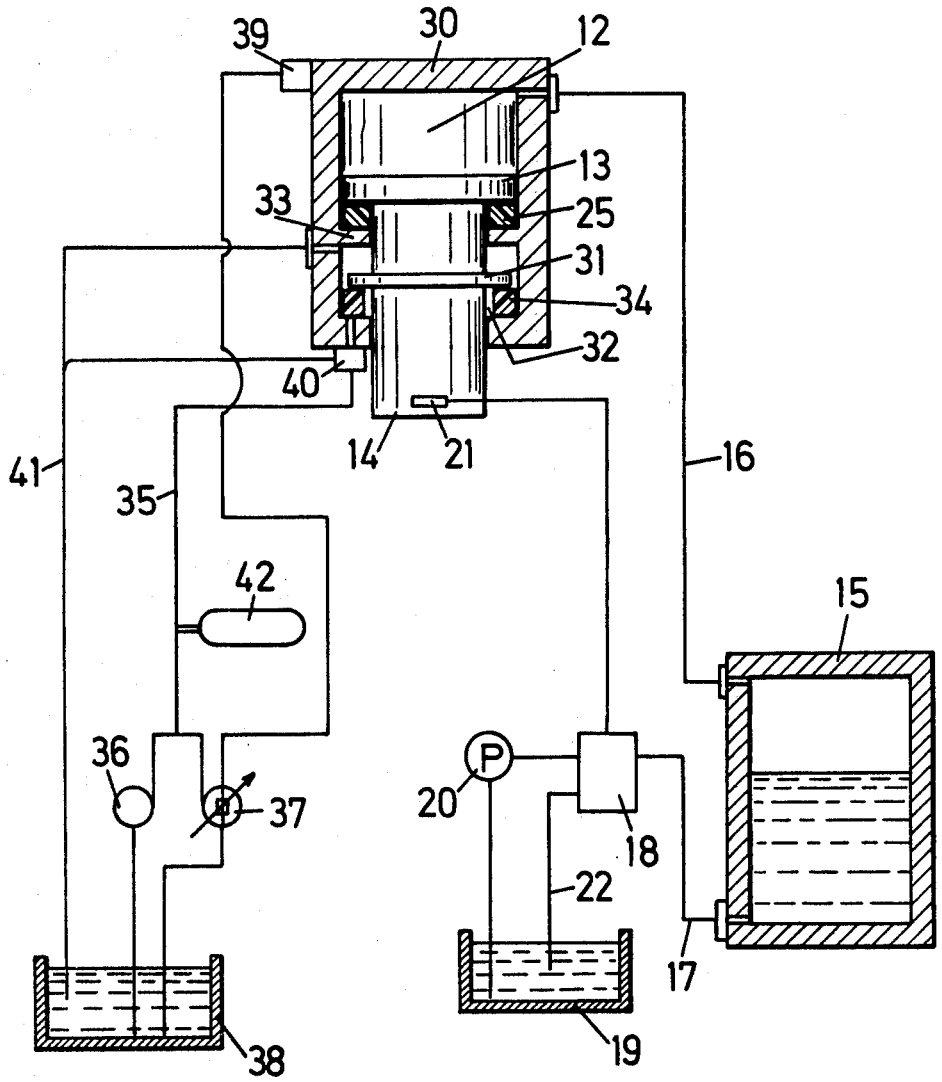
FIG. 2 shows a modified embodiment, where the impact cap is made integral with the hammer, and means are provided to preload the piston of the impact cap, in order to bring about a return movement of the hammer.

In the embodiment according to FIG. 2 the impact cap is built into a hammer 30, and will thus move together with the latter.

The function of the impact cap is the same as in the embodiment according to FIG. 1, and the same reference numerals are used to describe like components. The impact cap thus includes a cylinder 12, in which a piston 13 operates. One end 14 of the piston extends out of the casing forming the hammer and enclosing the impact cap.

The piston is in its most forward position supported by a resilient, annular member 25, and the cylinder communicates with pressure chamber 15 by way of conduit 16. The components cooperating with the pressure chamber, and adapted to govern the gas pressure are the same as above described, and need not be repeated, as mentioned they carry the same reference numerals as in FIG. 1.

In this embodiment, however, means are provided to impose a preload upon the impact cap, this pre-load causing a certain compression of the gas within cylinder 12.

Piston 13, 14 is provided with an annular, radial flange 31, which operates in a chamber 32 within the hammer casing 30, separated off from cylinder 12 by a partition wall 33.

Flange 31 cooperates with an annular sealing member 34 located within the chamber, and below the flange a conduit 35 supplying a pressure fluid is connected to the hammer casing, below the annular sealing member 34.

The pressure fluid is supplied by two pumps 36 and 37, the suction sides of which are connected to a receptacle 38, holding a quantity of the fluid.

The intention is to make the hammer operate fully automatically, so it is possible, by governing the preload upon the impact cap, to raise the hammer without the aid of any mechanical means. The hammer shall, in other words be thrown upwards from the pile by the pressure built into the impact cap. The height of the column of oil below the piston shall correspond to the expected sinking of the pile.

Pump 36 has a fixed displacement, and will cover about one half of the maximum fluid flow required, while pump 37, operating in parallel thereto, has a variable displacement and is used for controlling the drop height, which is dependent upon the degree of pre-load.

The variable pump 37 is governed by an electronic transmitter 39, which is mounted upon hammer 30, or upon piston 14. The hammer is provided with a valve 40, which cuts off the supply during the impact. Piston 14 is retarded when it contacts the pile, and a passage is made free between flange 31 and the annular sealing member 34 to connect chamber 32 with receptacle 38, by way of a return conduit 41.

The connection between valve 40 in conduit 35 and the chamber 32, will be closed by mechanical or hydraulic means, during the impact, for instance by a finger at piston 14 contacting the pile. During the short time when valve 40 is closed, the fluid supported by the pumps is taken care of by an accumulator 42.

The pressure in chamber 32 will thus be considerably reduced when the hammer reaches the pile. When the hammer, due to the expansion of gas within cylinder 12 is thrown upwards - that magnitude of such movements being determined by the pre-load previously imparted to the impact cap - pressure fluid is again introduced into chamber 32, i.e. while the hammer is still moving upwards, and is separated from the pile.

As conduit 35 opens below annular sealing member 34, the latter will be lifted to contact with flange 31, and closes, together with the latter the chamber below the flange. Fluid is introduced in a quantity corresponding to the amount of pre-load necessary to raise the hammer sufficient for obtaining the desired drop-height.

This is, as stated above, determined by transmitter 39.

When the piston contacts the pile, it will be forced into the cylinder, and the contact between flange 31 and annular sealing member 34 is interrupted. The annular sealing member, being free-floating, continues its downward movement in relation to the piston, and pressure fluid may flow past flange 31, to the upper outlet from chamber 32.

Figure 3:
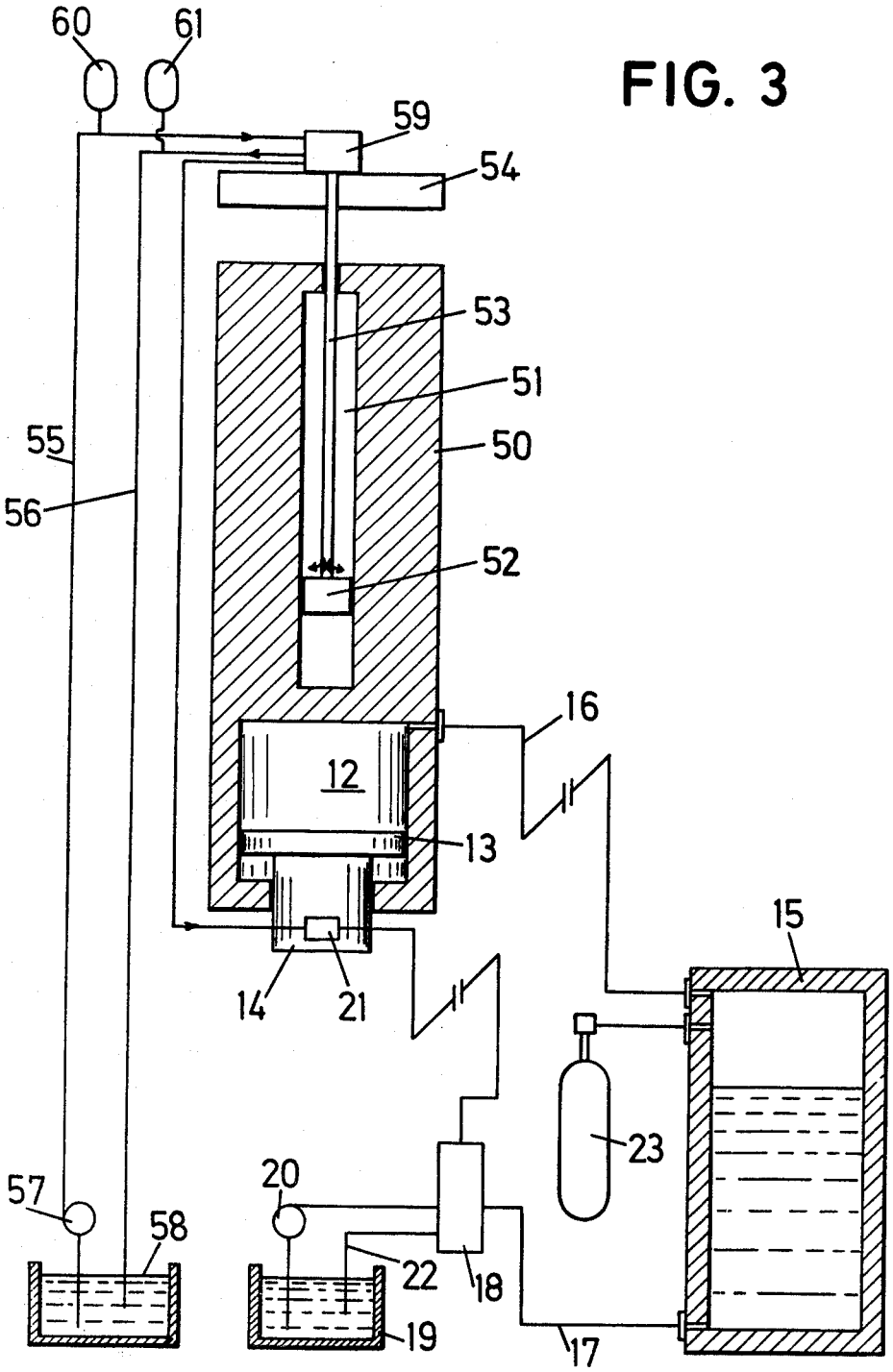
FIG. 3 shows an alternative embodiment of a hammer with integral impact cap, where the hammer is raised by hydraulic pressure.

FIG. 3 shows a modified embodiment, in which an impact cap of the type described in connection with FIG. 1 is built into the casing of a hammer 50.

The components intended for governing the gas pressure within the cylinder, and the impact cap itself are described by the same reference numerals as in the previous figures, and these components are not repeated again.

The intention is here that the hammer shall be raised hydraulically.

The casing of hammer 50 encloses a second cylinder 51, in which a piston 52 operates. This piston is mounted upon a hollow rod 53, which projects through the upper end of the casing, and is attached to a support 54. This may be regarded as being stationary during the lifting operation, but most of course be manipulated so it follows the sinking movement of the pile.

The hollow piston rod 53 communicates in the cylinder 51, close by piston 52, and is connected to two conduits 55, 56 conducting a hydraulic fluid.

Conduit 55 supplies hydraulic fluid, drawn by a pump 57 from a receptacle 58, to a valve 59 mounted upon support 54. Conduit 56 serves for returning fluid back to receptacle 58 from valve 59. Valve 59 is governed from signal transmitter 21, or in any other suitable manner, and will determine the flow of hydraulic fluid in to, and out of cylinder 51, respectively so the drop height will be the proper one.

It is evident that the hammer 50 will be raised in relation to the stationary piston 52, when hydraulic fluid is supplied through conduit 55 and valve 59, but will drop when the walve opens the connection to return flow conduit 56.

By a suitable programming of the signal transmitter it is possible to obtain varying drop-heights, for instance in relation to variations in the speed of piston 14. Accumulators 60 and 61, respectively, are connected to conduits 55 and 56, to take care of the fluid flow, when valve 59 shuts-off the connection to cylinder 51, or during the sudden effluent shock, when valve 59 opens to permit the hammer to drop, respectively.

Under certain circumstances it may be advantageous to relate the drop height to the pressure of the gas within the impact cap cylinder.

It is evident that the piston rod 53 may be solid and the hydraulic fluid be transferred to, and from, cylinder 51 by means of a flexible hose.

FIGS. 4 and 5 show two embodiments where the hydraulic raising cylinder 51 is open towards the cylinder 12 of the impact cap, whereby the pressure of the gas may act upon the inward face of piston 52. The pressure of the hydraulic fluid, thus, is higher than the lowest, normal gas pressure. As the hammer is raising the compression of the gas will be increased, which contributes to the acceleration during the dropping movement. The arrangement according to FIG. 4 corresponds to that of FIG. 3, and the same reference numerals are used. The only difference is, as above stated, that cylinder 51 communicates with cylinder 12 by way of an extension 65, which, however, can be formed as a passage having a reduced cross sectional area, compared to that of cylinder 51.

FIG. 5 shows a combination of hammer and impact cap, and adapted for automatic raising in the manner described in connection with FIG. 2, and further being provided with means for increasing acceleration during the dropping movement, as described in connection with FIG. 4. Occasionally, for instance to initiate the automatic movement, the raising of the hammer may be brought about by supplying hydraulic fluid as in FIG. 4.

The same reference numerals as in FIG. 2 are used in connection with the hammer and the impact cap, and for the hydraylic raising means the same reference numerals as in FIGS. 3 and 4 are used. The operation of this system is self-evident, and it is not necessary to describe the various steps once more. The arrangement, however, presupposes that valve 59 is manually governed, and is independent of signal transmitter 21. When the operation has reached its automatic stage no hydraulic fluid is supplied to cylinder 51.

All embodiments have been described as operating upon a pile, but it is evident that equipment of this type may be used for instance for the driving of sheet piles, or for driving, or extracting, respectively, elongate members of arbitrary kind.

In order to differentiate the various functions, the denomiation "oil" has been used in connection with the governing of the gas pressure within the cylinder in the impact cap, "pressure fluid" for obtaining a pre-load upon the piston, and "hydraulic fluid" for raising the hammer axially. It is evident that in practice, the same fluid will often be used for performing all three operations.

The connections between the impact cap and the sources supplying gas and pressure fluid may include flexible hoses, kneejoints or telescopic pipe members, which are connected to an intermediary, following the sinking movement of the pile.

The conduit communicating the impact cap and the pressure chamber is, in use, always open, and the pressure chamber has such size, that the combined gas volumes can accept the momentary compression caused by the impact, without the pressure being noticeably increased.

What I claim is:

1. A device for displacing an elongate member, for instance a pile by means of a drop hammer, comprising an — impact cap for transferring impacts from said drop hammer to said elongate member, said impact cap enclosing a cylinder, a — piston operable in said cylinder to define a gas chamber therein and having a portion extending outside of the cylinder for acting against said elongate member, a — pressure chamber, separate from the impact cap, conduit means to communicate said gas chamber and said pressure chamber to form a closed gas volume, pumping means for supplying a pressurized liquid to said pressure chamber and valve means for governing the supply to, and spilling of liquid from said pressure chamber, a — sensing means adjacent to the end of said elongate member acted upon by the impact cap for converting conditions in said elongate member, dependent upon the resistance met by said member during movements caused by impacts thereon, into transmittable signals, and means — adapted to receive such signals and to actuate said valve means in response thereto for determining the volume of liquid in said pressure chamber.

2. The device according to claim 1, further including a receptacle for pressurized gas connectable to the gas side of pressure chamber.

3. The device according to claim 1, in which the impact cap is integral with the hammer and means, connectable to the hammer, is adapted to impart a preload upon the piston of said impact cap, further means being provided to release said pre-load by the impact upon the member.

4. The device according to claim 3, in which the means for preloading the impact cap includes a second pump, having a fixed displacement, and a third pump, having a variable displacement and being connected in parallel to said second pump, said second and third pumps being connected to the impact cap to supply a pressure fluid to said impact cap to act upon the piston therein, contrary to the action of the gas pressure.

5. The device according to claim 4, in which the second pump, having the fixed displacement, is dimensioned to supply about one half of the maximum volume of liquid required for obtaining the preload.

6. The device according to claim 4, including means adjacent to the end of said member acted upon by said piston for governing said third pump, having the variable displacement.

7. The device according to claim 4, further including a partition wall in said cylinder defining a separate chamber therein, an annular flange upon the piston, displaceable within said separate chamber, and a free-floating annular sealing member for cooperation with said annular flange, supply conduits from said second and third pumps being connected to said separate chamber.

8. The device according to claim 7, further including a common supply conduit from said second and third pumps to said separate chamber, and a valve in said common conduit, being adapted, at the impact, to shut off the connection between said supply conduit, and said separate chamber.

9. The device according to claim 8, further including an accumulator connected to the supply conduit, and adapted to store the liquid supplied by said second and third pumps, while the valve cuts off the connection to the chamber.

10. The device according to claim 1, in which the cylinder is provided with an inwardly directed, annular partition wall, and a resilient annular member is fitted for cooperation with said partition wall.

11. The device according to claim 1, where the impact cap is formed integral with a hammer and further includes a second cylinder formed within the hammer, a second piston in said further cylinder, means for holding said second piston temporarily stationary with respect to the surroundings, a hollow piston rod reaching from said second piston out of the hammer, as well as means for raising and dropping the hammer in relation to said second piston, by means of a hydraulic fluid supplied, or withdrawn, respectively, by way of said hollow piston rod.

12. The device according to claim 11, further including means adjacent to the end of said member acted upon by the first piston of the impact cap for governing a valve determining the flow of hydraulic fluid in to, and out of, said further cylinder, respectively.

13. The device according to claim 11, further including means communicating said further cylinder with the cylinder of the impact cap.

* * * * *